US010894681B2

(12) United States Patent
Gesner et al.

(10) Patent No.: US 10,894,681 B2
(45) Date of Patent: Jan. 19, 2021

(54) SHEET REGISTRATION USING ROTATABLE FRAME

(71) Applicant: Xerox Corporation, Norwalk, CT (US)

(72) Inventors: Matthew L. Gesner, Rochester, NY (US); Kenneth E. VanDeWater, Rochester, NY (US); Husein Naser Kasim Rashed, Webster, NY (US); Jason M. LeFevre, Penfield, NY (US); Douglas K. Herrmann, Webster, NY (US); Paul J. McConville, Webster, NY (US); Chu-heng Liu, Penfield, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 111 days.

(21) Appl. No.: 15/963,134

(22) Filed: Apr. 26, 2018

(65) Prior Publication Data

US 2019/0330000 A1 Oct. 31, 2019

(51) Int. Cl.

| | |
|---|---|
| ***B65H 9/00*** | (2006.01) |
| ***B65H 9/20*** | (2006.01) |
| ***B65H 5/06*** | (2006.01) |
| ***G03G 15/00*** | (2006.01) |
| ***B41J 11/46*** | (2006.01) |
| ***B65H 5/22*** | (2006.01) |

(52) U.S. Cl.

CPC ..... *B65H 9/002* (2013.01); *B41J 11/46* (2013.01); *B65H 5/062* (2013.01); *B65H 5/224* (2013.01); *B65H 9/20* (2013.01); *G03G 15/5029* (2013.01); *G03G 15/6561* (2013.01)

(58) Field of Classification Search

CPC . B65H 9/00; B65H 9/002; B65H 9/18; B65H 9/20; B41J 11/46

See application file for complete search history.

(56) References Cited

U.S. PATENT DOCUMENTS

| | | | | |
|---|---|---|---|---|
| 4,462,527 | A | 7/1984 | Taylor et al. | |
| 4,579,444 | A | 4/1986 | Pinckney et al. | |
| 6,488,275 | B2 | 12/2002 | Schlageter | |
| 6,533,268 | B2 | 3/2003 | Williams et al. | |
| 6,634,521 | B1 | 10/2003 | Hwang | |
| 6,779,791 | B2 | 8/2004 | Kawamura et al. | |
| 7,243,917 | B2 | 7/2007 | Knierim et al. | |
| 7,404,557 | B2 * | 7/2008 | Tada | B65H 7/10 271/226 |

(Continued)

*Primary Examiner* — Thomas A Morrison

(74) *Attorney, Agent, or Firm* — Gibb & Riley, LLC

(57) ABSTRACT

Alignment apparatuses include a frame and contact elements connected to the frame. The contact elements contact items that are to be transported in a processing direction relative to the frame. The contact elements are in permeant fixed positions relative to the frame, and do not move relative to the frame. Adjustable mounts are connected to the frame and move the frame in the processing direction and in a perpendicular cross-processing direction. A controller is electrically connected to the adjustable mounts, and the controller is adapted to control the adjustable mounts to simultaneously move the frame and all the contact elements in the cross-processing direction and the processing direction while rotating the frame. Methods laterally shift imaging on sheets that have had rotational correction performed by such alignment apparatuses.

13 Claims, 20 Drawing Sheets

(56) References Cited

U.S. PATENT DOCUMENTS

| | | | | |
|---|---|---|---|---|
| 7,686,298 | B2 | 3/2010 | Fioravanti et al. | |
| 8,073,378 | B2 | 12/2011 | Calamita et al. | |
| 8,328,188 | B2 | 12/2012 | Mandel et al. | |
| 9,296,584 | B2 | 3/2016 | Banai et al. | |
| 2002/0074717 | A1* | 6/2002 | Schlageter ..... | B65H 9/002 271/226 |
| 2007/0145667 | A1 | 6/2007 | Pasuch et al. | |
| 2009/0115124 | A1* | 5/2009 | Fioravanti ..... | B65H 7/10 271/227 |

* cited by examiner

SHEET REGISTRATION USING ROTATABLE FRAME

BACKGROUND

Systems and methods herein generally relate to devices that transport and align sheets, and more particularly to sheet registration methods and devices that have a rotatable frame.

Many machines utilize sheet transports (belts, rollers, etc.) to feed sheets from one processing element to another. For example, it is common for printing devices to transport cut sheets of print media from a web of material or a storage area to a marking engine to allow printing to occur on such sheets of print media. Various factors can contribute to causing sheets to become misaligned when using such transport devices, which can result in defects, such as skewed printing.

Therefore, systems have been developed to maintain alignment between the transport devices and the sheets being transported. For example, physical guides that contact the edges of the sheets can be used to keep the sheets aligned. Other systems utilize sensors, such as optical sensors, physical contact sensors, etc., to detect whether the sheets of media are properly aligned with (registered with) the desired location on the transport devices. Once the amount of misalignment (commonly referred to as skew) is found by the sensors, different corrective measures can be taken to realign (re-register) the sheet with the transport devices. In one example, rollers that form transport nips can be rotated at different speeds (while multiple nips simultaneously contact the skewed sheet) to remove the skew and register the sheet properly. However, such systems can place stresses on the sheets, which can damage sheets; and such systems may not work effectively if the nips cannot properly grip the sheets.

SUMMARY

Various alignment devices herein can be used with machines that transport and align sheets, such as printers and similar devices. Exemplary alignment methodologies herein transport a sheet in a processing direction onto a rotatable transport. Such methods determine the amount of rotation of the sheet relative to the processing direction and, after all of the sheet is on the rotatable transport, these methods rotate, in a reverse rotation relative to the direction of skew, the transport by the amount of rotation of the sheet (potentially using just a single actuator) to place the rotatable transport in a compensating rotated position. The rotation of the transport is relative to the fixed-position marking transport. Thus, the sheet is un-rotated relative to the processing direction when the rotatable transport is in the compensating rotated position.

These methods also transport the sheet using the rotatable transport, in the compensating rotated position, to transport the sheet to a marking transport. Note that skew is only corrected by the compensating rotated position of the rotatable transport, and that the drive nips of the rotatable transport all rotate at the same rate, which avoids issues that occur when correcting rotational skew with different nip speeds. Such methods further determine the amount the sheet (e.g., the midline of the sheet) is laterally offset from an alignment position of the marking transport.

Methods herein transport the sheet using the marking transport to a marking engine and print marks on the sheet using the marking engine. These methods print marks on the sheet using the marking engine by laterally offsetting the printing marks an amount equal to the amount the sheet is laterally offset from the alignment position of the marking transport. The amount the midline of the sheet is laterally offset from the alignment position of the marking transport (and the laterally offsetting process) are in a cross-process direction that is perpendicular to the processing direction.

Exemplary alignment apparatuses herein include (among other components), a frame (e.g., rectangular frame), and contact elements, such as rollers that form drive nips, vacuum belts, etc. The contact elements are operatively (meaning directly or indirectly) connected to, and supported by, the frame. The contact elements are shaped and positioned to contact items (such as sheets of print media) that are to be transported in the processing direction relative to the frame. Also, the contact elements are in permanent fixed positions relative to the frame, and do not move relative to the frame. The contact elements are moveable (e.g., rotatable, etc.) at such fixed positions, so as to move the items in the processing direction.

Additionally, such exemplary alignment apparatuses include adjustable mounts (such as actuators, etc.) connected to the frame. The adjustable mounts are connected to the frame in locations (such as corners of a rectangular frame) that cause the adjustable mounts to move the frame in the processing direction and in a cross-processing direction (that is perpendicular to the processing direction). Thus, the adjustable mounts include first adjustable mounts that are positioned to move the frame in the cross-processing direction, and second adjustable mounts that are positioned to move the frame in the processing direction. A controller is electrically connected to the adjustable mounts. In addition, such structures include a sensor electrically connected to the controller. The sensor is positioned to detect the alignment of the items relative to the processing direction.

The controller is adapted to independently control the adjustable mounts to simultaneously rotate the frame and all the contact elements in a clockwise rotation or a counterclockwise rotation. Also, the controller is adapted to synchronously control the adjustable mounts to simultaneously move the frame and all the contact elements in a cross-processing direction and the processing direction. In other words, the controller is adapted to control the adjustable mounts to simultaneously rotate the frame while moving the frame in the processing direction and the cross-processing direction; therefore, the controller can cause the frame to rotate, while simultaneously moving the frame outboard or inboard, and while advancing or retarding the frame in the processing direction.

Some structures herein include a secondary frame that is positioned within a perimeter of the aforementioned frame (which is sometimes referred to herein as the primary frame). In such structures, secondary contact elements are operatively connected to the secondary frame. Such secondary contact elements are shaped and positioned to similarly contact the items being transported in the processing direction. Similarly, the secondary contact elements are in secondary fixed positions relative to the secondary frame, and the secondary contact elements are moveable (e.g., rotatable) at such secondary fixed positions to move the items in the processing direction.

Also, such alternative structures include secondary adjustable mounts that are connected to the secondary frame and the primary frame, wherein the secondary adjustable mounts are connected to the secondary frame in locations to move the secondary frame parallel to the processing direction of the frame. The secondary adjustable mounts are also electrically connected to the controller, and the controller is similarly adapted to control the secondary adjustable mounts to move the secondary frame parallel to the processing direction of the frame while simultaneously rotating the primary frame and moving the primary frame in the cross-processing direction.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1A:
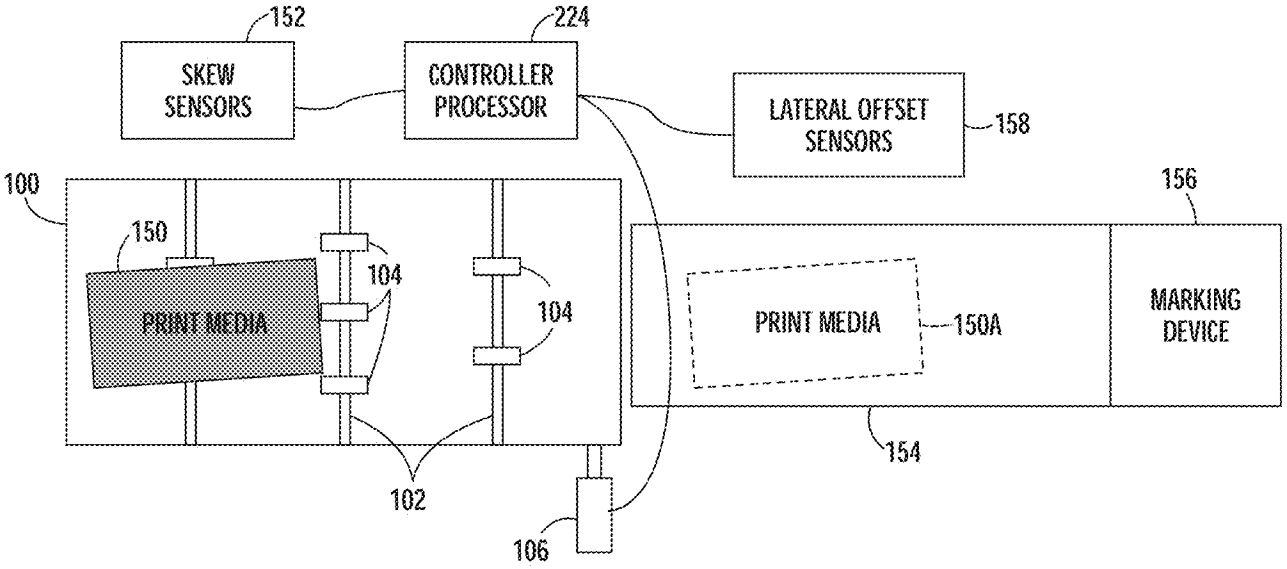
FIGS. 1A-1C are schematic conceptual diagrams illustrating alignment devices herein operating with marking transports and marking devices.

As mentioned above, registration systems that unevenly rotate drive nips can place stresses on the sheets, which can damage sheets; and such systems may not work effectively if the nips cannot properly grip the sheets. In one specific example, multiple (e.g., 3) nips are sometimes used to provide different nip stance offsets depending on the paper cross-process width. In such systems, the two outside nips are used for wide sheets, while one outside nip and the center nip together are used for more narrow sheets, to handle the different moments wide and narrow sheets present.

One issue with such systems is that the smallest stance needed to handle very small sheets (e.g., 7" paper) can adversely affect large sheet registration, and this is due to the force/moment balance created as a result of the nips being so close together and offset to one side of the sheet. In such situations, both the inertia of the sheet and the frictional forces on the sheet act through the centerline or center of gravity (CG) of the sheet, which is offset by the distance to the registration nips. Heavy-weight large/wide sheets present high inertial loads at the registration nips which lead to slip and degrade registration performance.

In view of such issues, devices herein separate the overall TOP (Image-on-Paper) registration process into its individual components of "de-skew" and "lateral" registration, and correct each using separate processing rather than using nip steering to perform both functions. With devices herein, the sheet "de-skew" process is started by first measuring the incoming skew (rotation from parallel to the processing direction) of the sheet as it enters the "de-skew" transport. This sheet "de-skew" transport is located immediately upstream of the marking transport.

The sheet "de-skew" transport has a series of drive rollers in arrangement similar to the rest of the machine paper path (e.g., 3 rollers across the process direction, spaced to accommodate all media sizes). The drive rollers and their drive mechanisms are all attached to a common sub-frame, and are square to that sub-frame. The sub-frame pivots about a point (relative to the machine frame) on the upstream end of the "de-skew" transport (allowing the entire module to swing the downstream end either towards the outboard (OB) or inboard (IB) end of the machine). Since the sheet "de-skew" does not occur using nip steering within the module (nip steering adjusts roller speeds differently to steer the sheet) the sheet inertial forces are not an issue when sheets of extended length or width are processed (in the devices herein all rollers feed (rotate) at the same speed).

Using the initial sheet skew measurement, and after allowing the sheet to be controlled entirely by the nips on the "de-skew" transport, the process of articulating the sub-frame is performed. The processor determines the amount to skew the sub-frame relative to the machine frame in order to de-skew the sheet relative to the marking transport. By using this processing, the sheet is delivered to the marking transport in a "de-skewed" orientation, but is not yet corrected for the "lateral" shift of the image relative to the sheet. After the sheet is delivered to the marking transport, the sub-frame can be re-centered, and then adjusted to de-skew the next sheet.

The TOP "lateral" adjustment occurs in the image path. The digital image itself (on a sheet-by-sheet basis) is corrected for the measured "lateral" shift of the sheet relative to the desired position on the sheet. This is performed because the image processing bandwidth needed to "de-skew" an image is very large. However, taking the image and "laterally" shifting the whole image over a certain number of pixels does not require as much computational bandwidth. In this way, both the "de-skew" and the "lateral" registration are corrected in a way that requires simple mechanism (potentially a single actuator for de-skew) and low processing bandwidth for the lateral shift.

FIGS. 1A-1C and 2 illustrate exemplary methods herein. More specifically, as shown in FIG. 1A, exemplary alignment methodologies herein transport a sheet of print media 150 in a processing direction onto a rotatable transport 100. Such methods determine the amount of rotation of the sheet of print media 150 relative to the processing direction using skew sensors 152. In FIG. 1A, item 150A represents where the sheet of print media would be placed on the marking transport 154 if the skew was not corrected.

Note that the controller/processor 224 (discussed below) and connections thereto are only shown in FIG. 1A, within the series of FIGS. 1A-1C, and that less than all connections to the controller/processor 224 are shown, to avoid clutter in the drawings; however, the controller/processor 224 is electrically connected to all elements that this disclosure describes as being connected to, or controlled by, the controller/processor 224 and the limited connections in FIG. 1A are intended to show (and would be understood to show, by one ordinarily skilled in the art) all such connections.

Figure 1B:
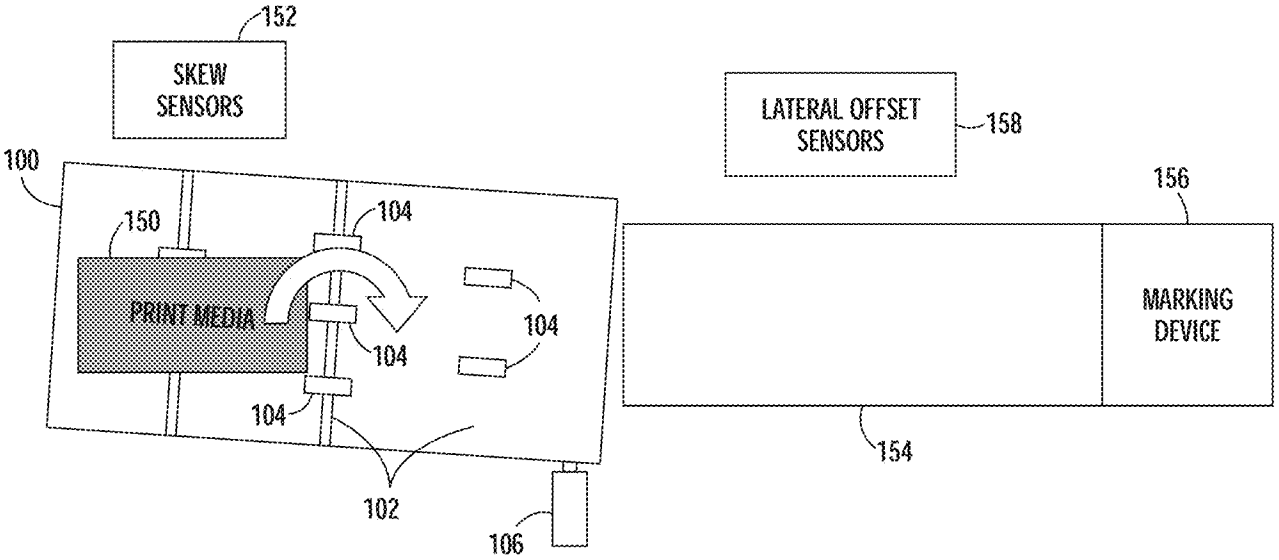
Figure 1C:
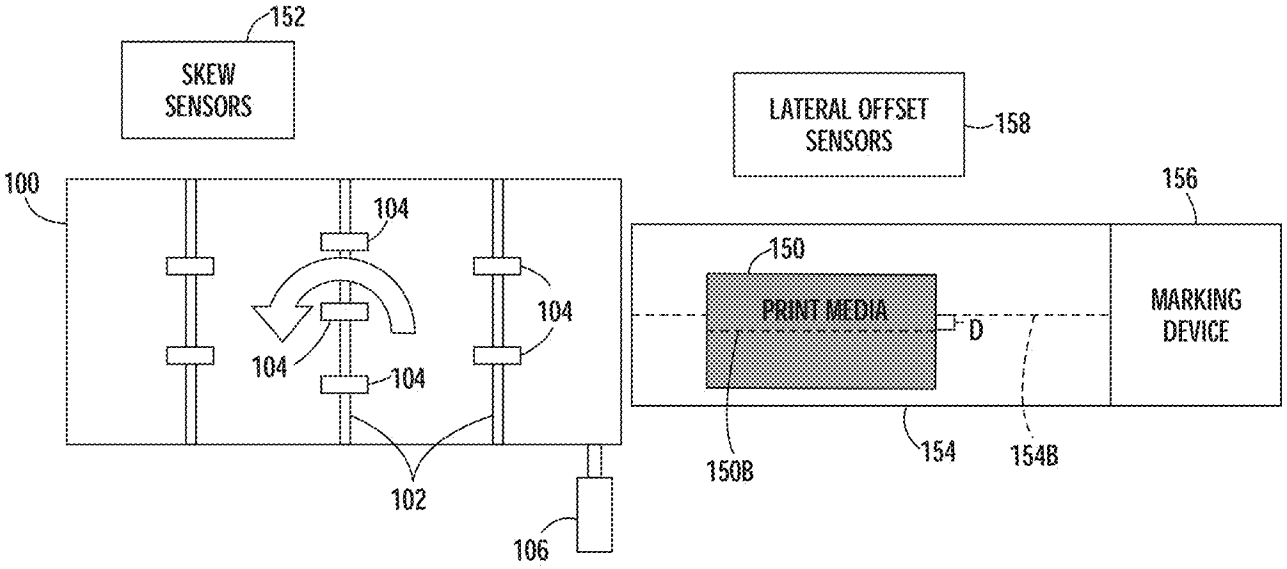

As shown in FIG. 1B, after all of the sheet of print media 150 is on the rotatable transport 100 (meaning that all the nips or belts of the transport 100 are contacting a portion of the print media 150), such methods rotate the transport 100 by the amount of rotation of the sheet of print media 150 (potentially using just a single actuator 106, but more actuators 106 could be used as shown in FIGS. 3A-10, discussed below) to place the rotatable transport 100 in a compensating rotated position. The compensating rotated position shown in FIG. 1B is in an opposite rotational direction from the rotation of the sheet of print media 150 (shown in FIG. 1A), and the rotation of the transport 100 is relative to the fixed-position marking transport 154. Thus, the sheet of print media 150 is un-rotated relative to the processing direction when the rotatable transport 100 is in the compensating rotated position, as shown in FIG. 1B. In the "un-rotated" position, the edges of the sheet are parallel to the processing direction.

These methods also transport the sheet of print media 150 using the rotatable transport 100, in the compensating rotated position, to transport the sheet of print media 150 to a marking transport 154 (which is a belt, rollers, etc.). Note that the rotational skew is only corrected by the compensating rotated position of the rotatable transport 100, and that the drive nips 104 supported by axles 102 of the rotatable transport 100 all rotate at the same rate, which avoids issues that occur when correcting rotational skew with different nip speeds. As shown in FIG. 1C, such methods further determine the amount (D) the sheet of print media 150 (e.g., edges of, or the midline 150B of, the sheet of print media 150) is laterally offset from an alignment position 154B of the marking transport 154. The midline 150B and the alignment position 154B are both lines that are parallel to the processing direction (and are perpendicular to the cross-processing direction). The alignment position 154B can be the midline of the marking transport, or some other line parallel to the processing direction that the marking device 156 uses to register marks on sheets.

The amount of lateral offset (D) can be determined by making calculations from the initial sheet position measured by the skew sensor 152, or a separate lateral offset sensor 158 can be used to only measure the amount of lateral offset (D). For example, when only using the skew sensor 152, the initial lateral (cross-process) position of the sheet of print media 150 is detected by the skew sensor 152 as the print media 150 is initially on the rotatable transport 100. Then a processor (such as processor 224, only shown in FIGS. 1A, 3A, and 11, to avoid clutter in the drawings, which is discussed below) calculates the change in lateral position that will occur based on the length of the rotatable transport 100 and the angle of the compensating rotated position relative to the processing direction. The combination (summation) of the change in lateral position and the initial lateral offset provides the amount (D) the sheet of print media 150 is laterally offset from an alignment position 154B of the marking transport 154, without need of a separate lateral offset sensor 158.

Methods herein thus transport the sheet of print media 150 using the marking transport 154 to a marking engine 156 and print marks on the sheet of print media 150 using the marking engine 156. After the print media 150 is delivered to the marking transport 154, the rotatable transport 100 can be re-centered, and then adjusted for the next sheet. More specifically, these methods print marks on the sheet of print media 150 using the marking engine 156 by laterally offsetting the printing marks an amount equal to the amount D the sheet of print media 150 is laterally offset from the alignment position 154B of the marking transport 154. The amount D the sheet of print media 150 is laterally offset from the alignment position 154B of the marking transport 154 (and the laterally offsetting process when printing) are in a cross-process direction that is perpendicular to the processing direction.

Figure 2:
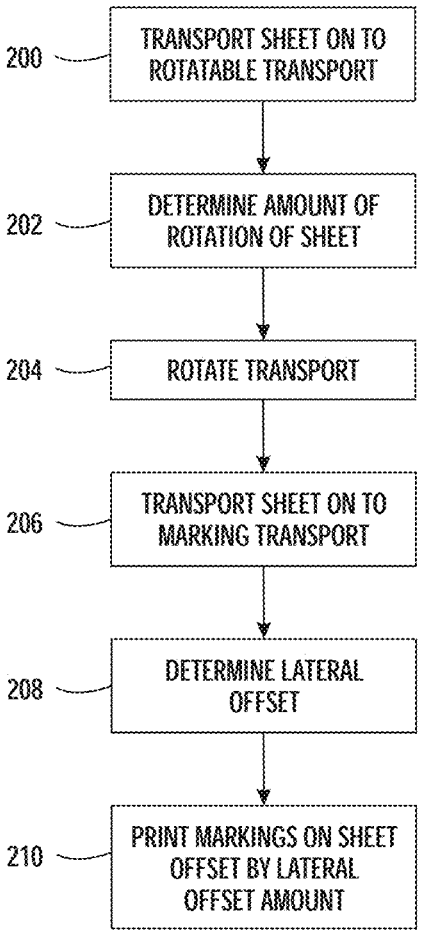
FIG. 2 is a flowchart illustrating processing herein.

This processing is also shown in flowchart form in FIG. 2. In item 200 in FIG. 2, methods herein transport a sheet in a processing direction onto a rotatable transport. Such methods determine the amount of rotation of the sheet relative to the processing direction in item 202. After all of the sheet is fully transported on to the rotatable transport, in item 204, these methods rotate the transport by the amount of rotation of the sheet (potentially using just a single actuator) in an opposite rotation to that of the sheet, to place the rotatable transport in a compensating rotated position. By waiting until the sheet if fully on the rotatable transport before starting rotation of the rotatable transport, the sheet is not subjected to twisting or torque forces, which avoids sheet damage and avoids slippage (thereby reducing belt/nip wear, etc.). The compensating rotated position is in an opposite rotational direction from the rotation of the sheet, and the rotation of the transport is relative to the fixed-position marking transport. Thus, the sheet is un-rotated relative to the processing direction when the rotatable transport is in the compensating rotated position.

In item 206, these methods also transport the sheet using the rotatable transport, in the compensating rotated position, to transport the sheet in the un-rotated (de-skewed) orientation to the marking transport. Note that rotational skew is only corrected by the compensating rotated position of the rotatable transport, and that the drive nips of the rotatable transport all rotate at the same rate when transporting the sheet, which avoids issues that would otherwise occur when correcting rotational skew with different nip speeds (slippage, damage, etc.).

In item 208, such methods further determine the amount the sheet is laterally offset (e.g., midline offset) in the cross-processing direction from a centerline alignment position of the marking transport. The amount of lateral offset can be determined in item 208 by making calculations from the initial sheet position measured by the skew sensor(s), or one or more separate lateral offset sensors can be used to only measure the amount of lateral offset. When only using the skew sensor in item 208, the initial lateral (cross-process) position of the sheet of print media is detected by the skew sensor as the print media is initially on the rotatable transport. Then the processing in item 208 can calculate the change in lateral position that is projected to occur based on the length of the rotatable transport and the angle of the compensating rotated position relative to the processing direction. The combination of the change in lateral position added to, or subtracted from, the initial lateral offset provides the amount the sheet of print media is laterally offset from the alignment position of the marking transport, without need of a separate lateral offset sensor.

As shown in item 210, methods herein print marks on the sheet using the marking engine. These methods print marks on the sheet using the marking engine in item 210 by laterally offsetting the printing marks an amount equal to the amount the midline of the sheet is laterally offset from the alignment position of the marking transport. The amount the sheet is laterally offset from the alignment position of the marking transport (and the laterally offsetting process) are in a cross-process direction that is perpendicular to the processing direction. Again, taking the image and "laterally" shifting the whole image over a certain number of pixels does not require as much computational bandwidth as rotational correction. Therefore, by physically correcting for sheet rotation from parallel to the processing direction by rotating the transport, and using computational bandwidth to correct for lateral shift within the marking device, the mechanical elements are simplified, without incurring a heavy computational burden on the processor.

FIGS. 3A-10 illustrate additional devices herein that may or may not be used with the processing described above. More specifically, as shown in FIGS. 3A-3F, similar to the structure discussed above, exemplary alignment apparatuses herein again include (among other components), the rotatable transport frame 100 (e.g., rectangular frame), and contact elements 104 on axles 102, such as rollers 104 that form drive nips. The contact elements 104 are operatively (meaning directly or indirectly through the axles 102) connected to, and supported by, the frame 100.

Again, the contact elements 104 are shaped and positioned to contact items (such as sheets of print media 150) that are to be transported in a processing direction relative to the frame 100. Also, the contact elements 104 are in permanent fixed positions relative to the frame 100, and do not move relative to the frame 100. The contact elements 104 are moveable (e.g., rotatable, etc.) at such fixed positions, so as to move the items in the processing direction.

Figure 3A:
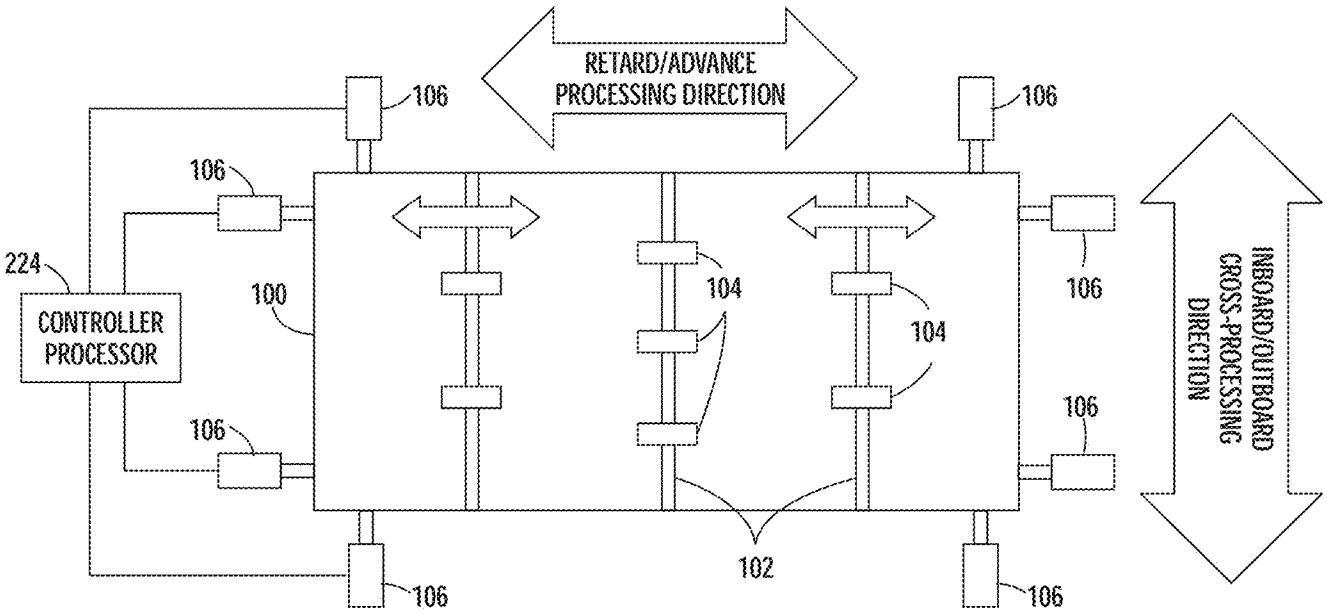
FIGS. 3A-6 are schematic conceptual diagrams illustrating alignment devices herein.
Figure 3B:
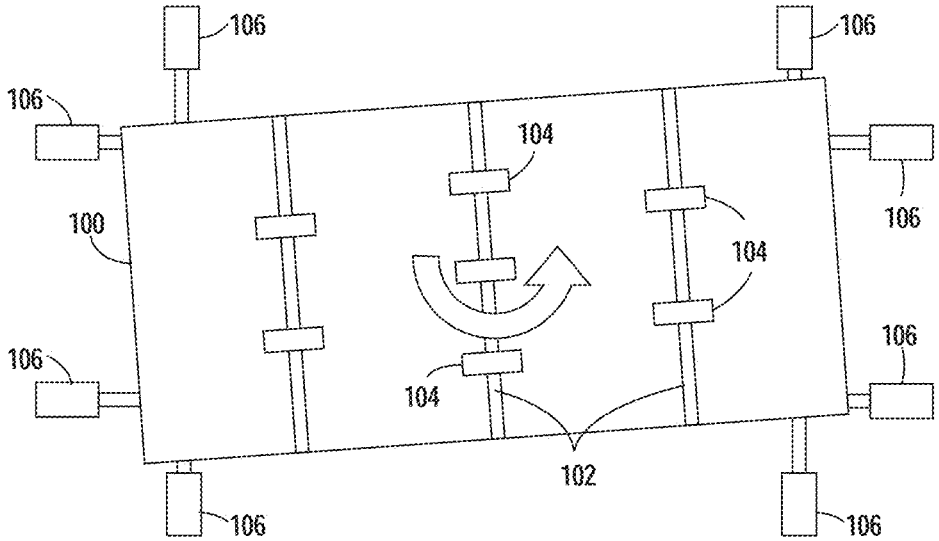

Additionally, FIG. 3A also illustrates that such exemplary alignment apparatuses include adjustable mounts 106 (such as actuators, etc.) connected to the frame 100. The adjustable mounts 106 are connected to the frame 100 in locations (such as corners of the rectangular frame 100) that cause the adjustable mounts 106 to move the frame 100 in the processing direction and in the cross-processing direction (that is perpendicular to the processing direction). Thus, the adjustable mounts 106 include first adjustable mounts that are positioned at corners of the frame 100 to move the frame 100 in the cross-processing direction, and second adjustable mounts that are positioned at corners of the frame 100 to move the frame 100 in the processing direction.

FIG. 3A also uses block arrows to illustrate the process direction (where items can be advanced in the processing direction or retarded opposite the processing direction) and to illustrate the cross-process direction (where items can be shifted inboard or outboard relative to the "front" of a printing device (e.g., the front is generally where the access door is located, so the location is arbitrary)). FIG. 3A also uses block arrows over the axles 102 to illustrate that the axles 102 can move parallel to the processing direction to adjust for different lengths of paper engagement. While such block arrows are only shown in FIG. 3A to reduce clutter in the other drawings, all other drawings are presented with the same reference to the same directions or orientations.

Note that the controller/processor 224 (discussed below) and connections thereto are only shown in FIG. 3A, within the series of FIGS. 3A-10, and that less than all connections to the controller/processor 224 are shown, to avoid clutter in the drawings; however, the controller/processor 224 is electrically connected to all elements that this disclosure describes as being connected to, or controlled by, the controller/processor 224 and the limited connections in FIG. 3A are intended to show (and would be understood to show, by one ordinarily skilled in the art) all such connections.

Figure 3C:
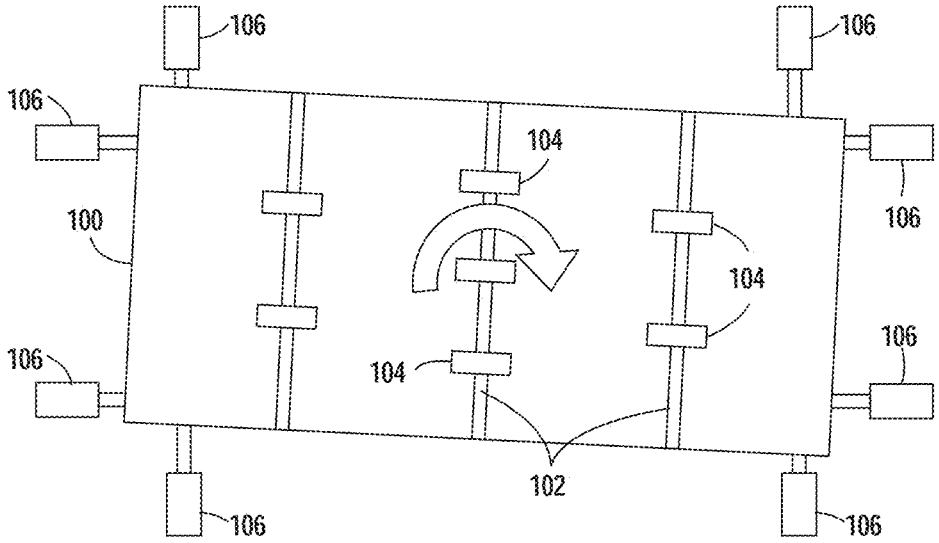
Figure 3D:
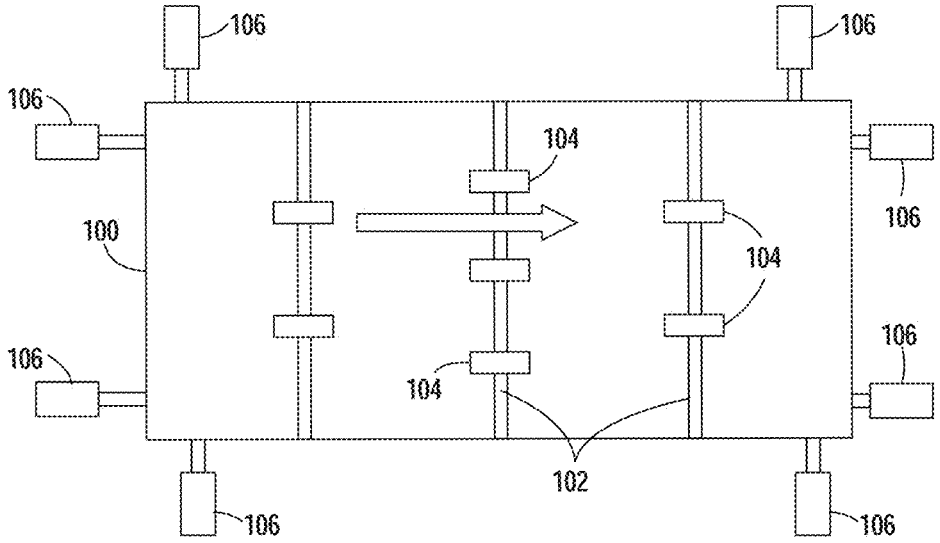
Figure 3E:
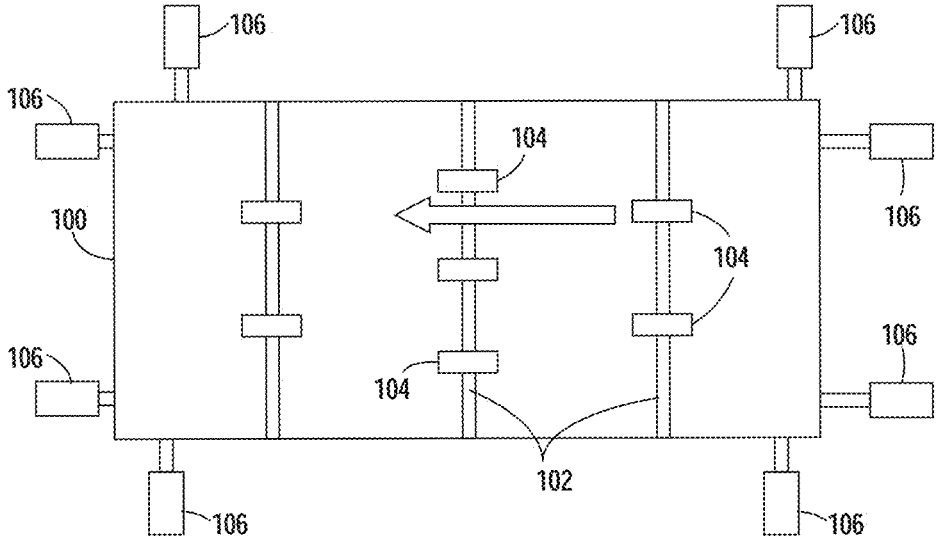
Figure 3F:
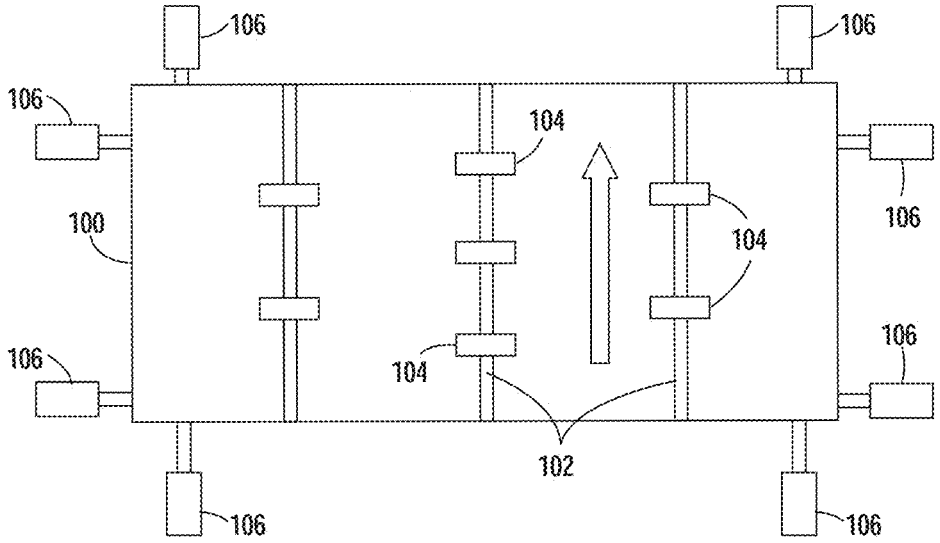
Figure 3G:
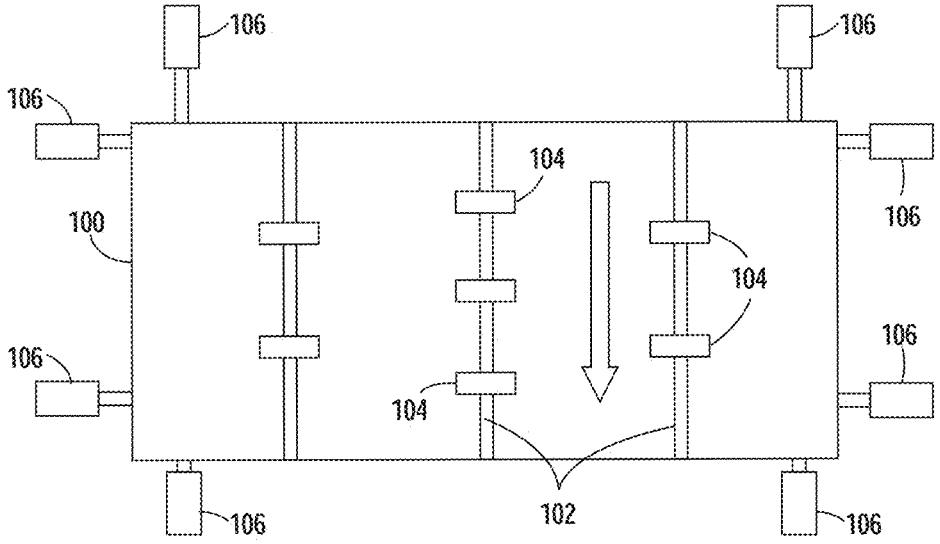

Thus, the controller 224 is electrically connected to all the adjustable mounts 106. The controller 224 is adapted to independently control the adjustable mounts 106 to simultaneously rotate the frame 100 and all the contact elements 104 in a counter-clockwise rotation (FIG. 3B) or a clockwise rotation (FIG. 3C). Also, the controller 224 is adapted to synchronously control the adjustable mounts 106 to simultaneously move the frame 100 and all the contact elements 104 parallel to the processing direction (FIGS. 3D-3E, where items can be advanced or retarded) and the cross-processing direction (FIGS. 3F-3G, where items can be shifted inboard or outboard).

Figure 4:
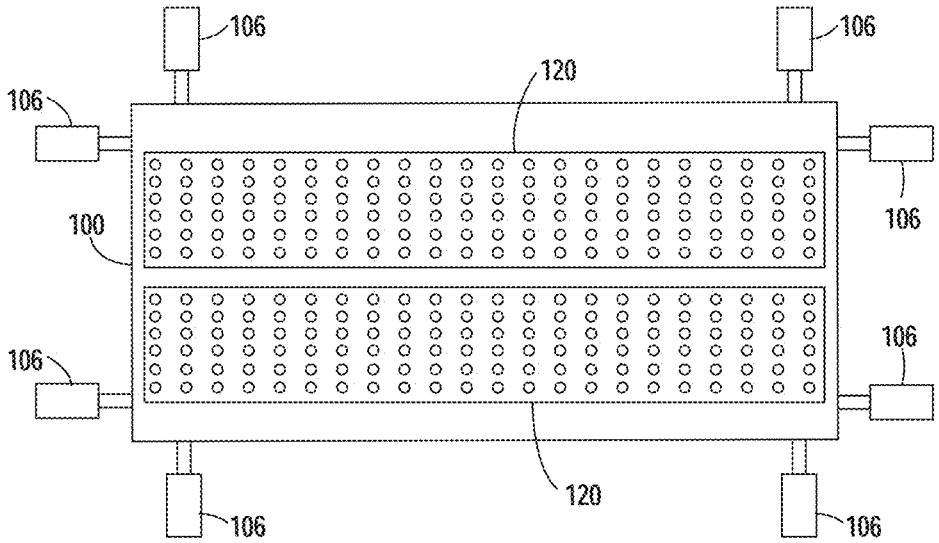
Figure 5A:
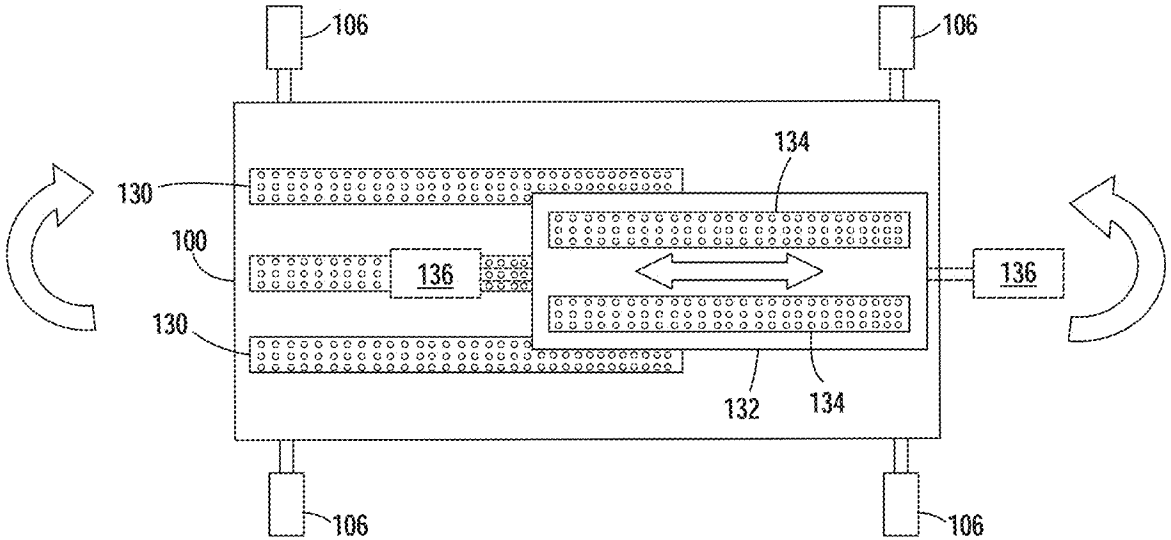

While FIGS. 3A-3G illustrate the contact elements 104 as roller nips, FIG. 4 illustrates that the contact elements can be parallel, separately driven belts 120; and FIG. 5A illustrates that the contact elements as variable transports (VGT) that include different sets of belts 130, 132 that can be moved (parallel to the processing direction of the frame) relative to one another using actuators 136 to provide different lengths of media engagement.

Figure 5B:
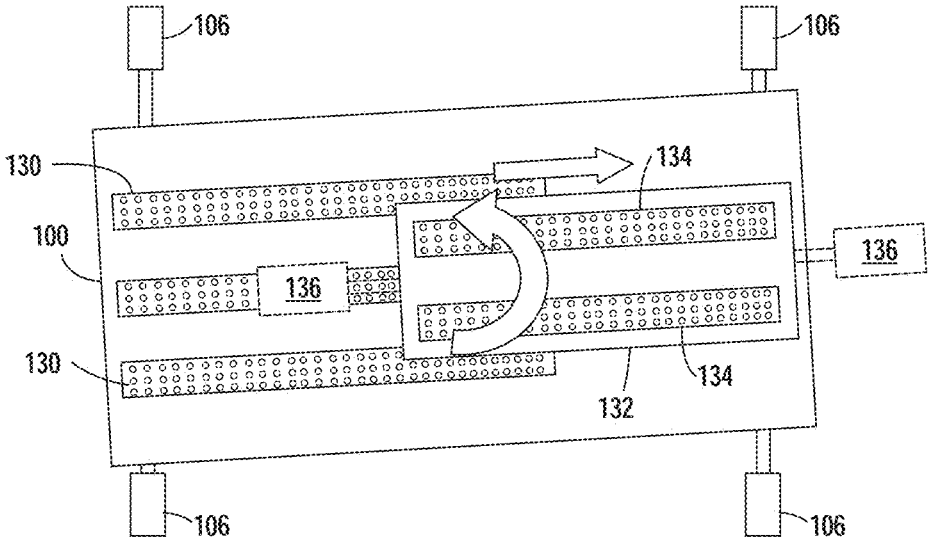
Figure 5C:
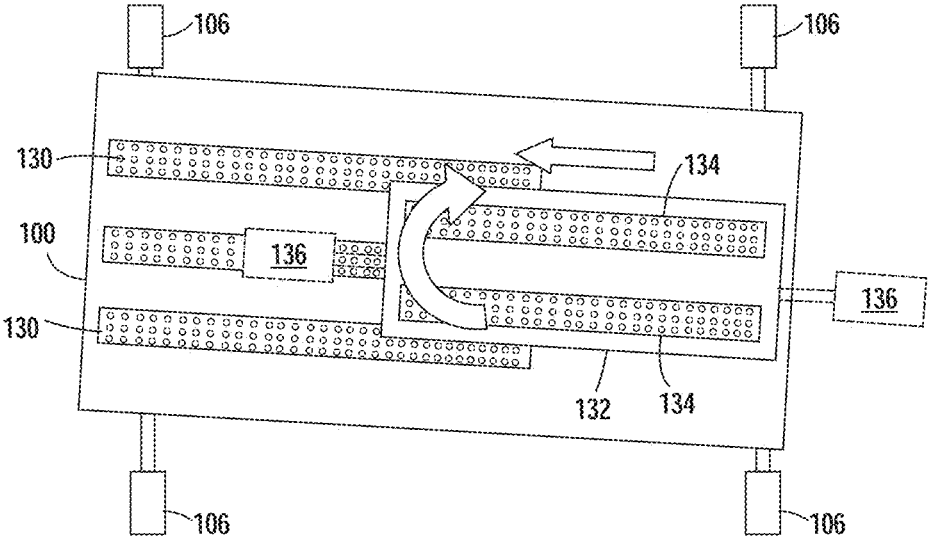

More specifically, the structures shown in FIGS. 5A-5C include a secondary frame 132 that is positioned within a perimeter of the aforementioned frame 100 (the primary frame 100). In such structures, secondary contact elements (belts 134) are operatively connected to the secondary frame 132. Such secondary contact elements 134 are shaped and positioned to similarly contact the items being transported in the processing direction. Similarly, the secondary contact elements 134 are in secondary fixed positions relative to the secondary frame 132, and the secondary contact elements 134 are moveable at such secondary fixed positions to move the items in the processing direction.

Also, such alternative structures include secondary adjustable mounts 136 that are connected to the secondary frame 132 and the primary frame 100, wherein the secondary adjustable mounts 136 are connected to the secondary frame 132 in locations to move the secondary frame 132 in the processing direction relative to the primary frame 100. The secondary adjustable mounts 136 are also electrically connected to the controller 224, and the controller 224 is similarly adapted to control the secondary adjustable mounts 136 to move the secondary frame 132 parallel to the processing direction of the primary frame 100 while simultaneously rotating the primary frame 100 and moving the primary frame 100 in the cross-processing direction. This is shown, for example, in FIG. 5B where the secondary frame 132 is advanced parallel to the processing direction of the primary frame 100, while the primary frame 100 is rotated counter-clockwise; and shown in FIG. 5C where the secondary frame 132 is retarded parallel to the processing direction of the primary frame 100, while the primary frame 100 is rotated clockwise.

Figure 6:
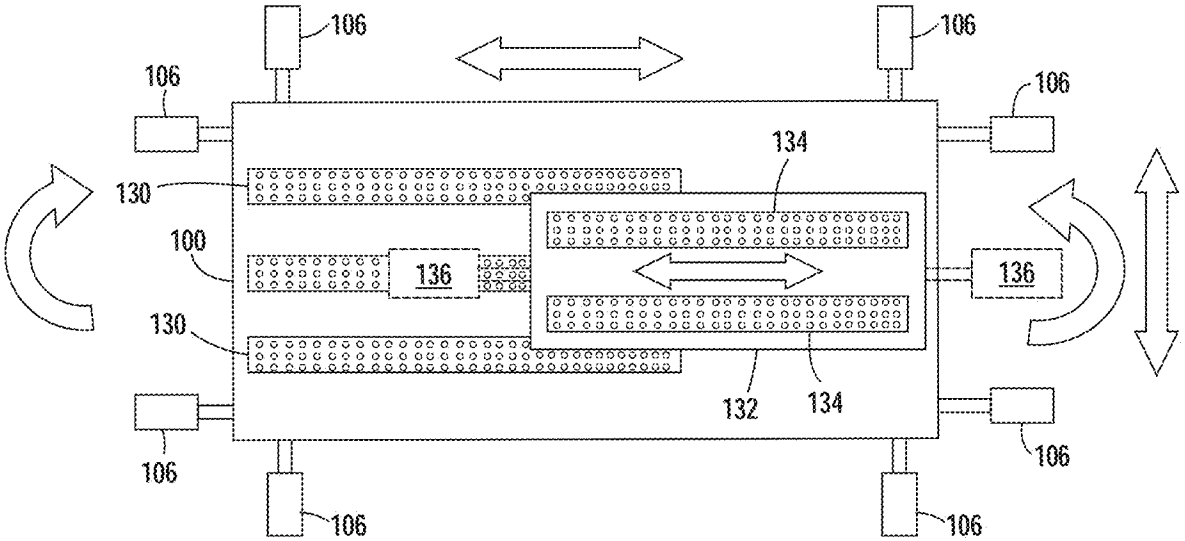

Note that FIGS. 5A-5C only illustrated adjustable mounts 106 connected to move the primary frame 100 parallel to the cross-processing direction. However, as shown in FIG. 6, additional mounts 106 could move the primary frame 100 parallel to the processing direction also. In other words, as shown in FIG. 6, the controller 224 is adapted to control the adjustable mounts 106 to simultaneously rotate the frame 100 while moving the frame 100 in the processing direction and the cross-processing direction; therefore, the controller 224 can cause the frame 100 to rotate, while simultaneously moving the frame 100 inboard or outboard in the cross-processing direction and advancing or retarding the frame 100 in the processing direction. In addition, such movement can simultaneously move the secondary frame 132 parallel to the processing direction of the primary frame 100.

Figure 7A:
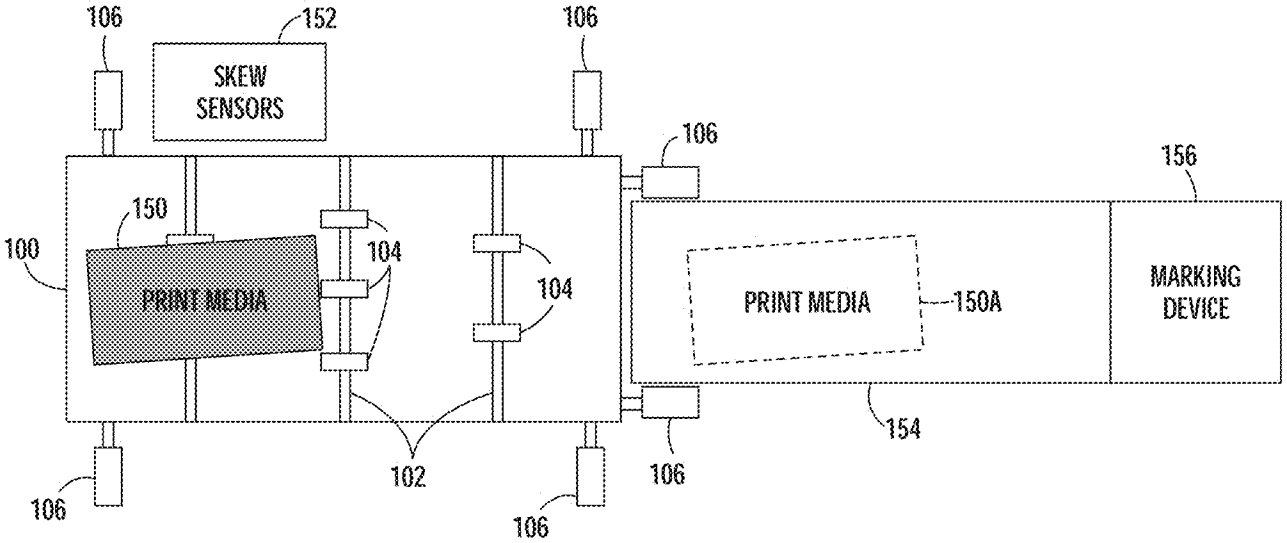
FIGS. 7A-8B are schematic conceptual diagrams illustrating alignment devices herein operating with marking transports and marking devices.
Figure 7B:
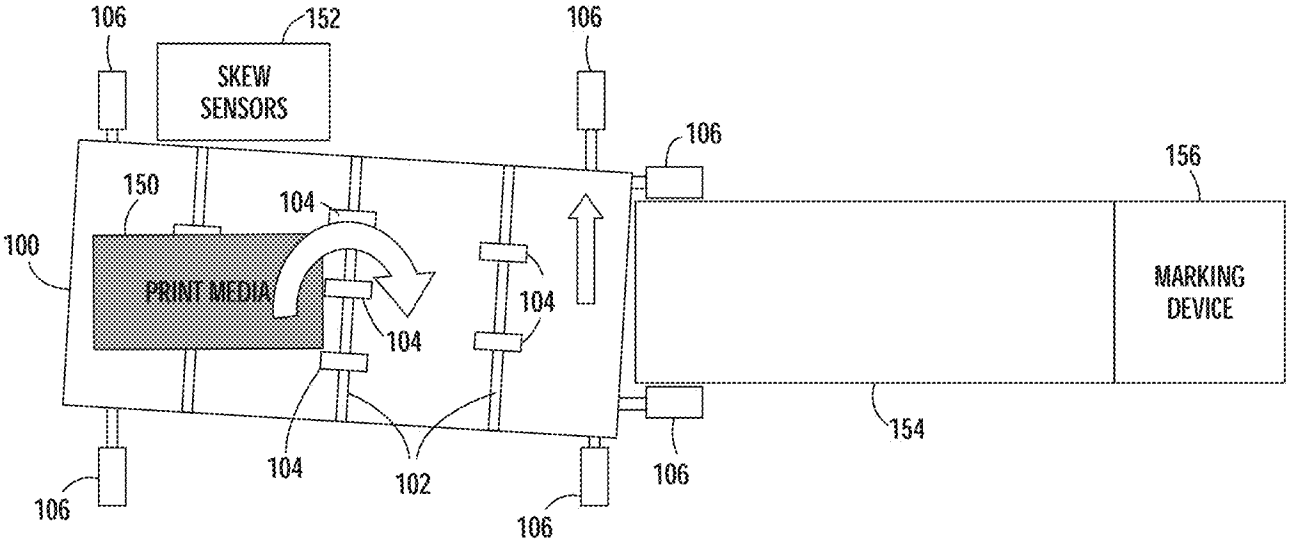
Figure 7C:
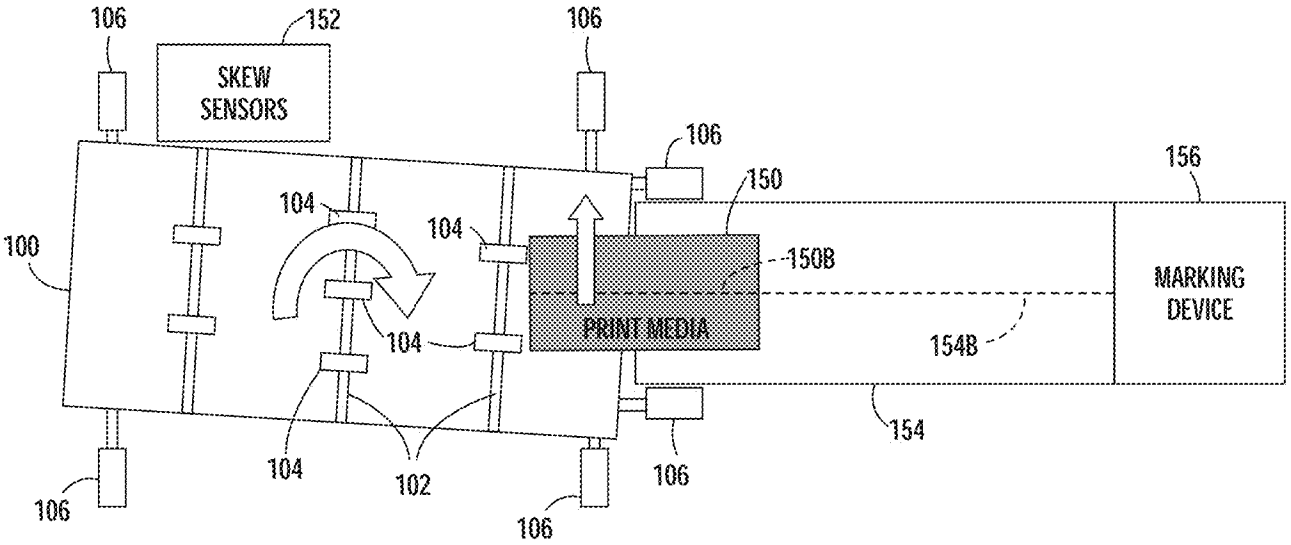

In addition, as shown in FIGS. 7A-8B, such structures include one or more skew sensors 152 electrically connected to the controller 224. The skew sensor(s) 152 are positioned to detect the alignment of the items relative to the processing direction. In FIGS. 7A-8B, item 150A represents where the sheet of print media would be placed on the marking transport 154. Thus, as shown in FIG. 7A, the skew sensor 152 detects the rotational skew and lateral offset (lateral skew) of the sheet of print media 150. In response, the controller 224 rotates the frame 100 to compensate for the rotational skew, and moves the frame parallel to the cross-processing direction to compensate for the lateral offset, as shown in FIG. 7B. This allows the print media 150 to be delivered to the marking transport 154 without rotational or lateral skew, allowing the marking device to place marks properly aligned on the sheet of print media 150, as shown in FIG. 7C (again illustrated using exemplary midline 150B and alignment position 154B).

Figure 8A:
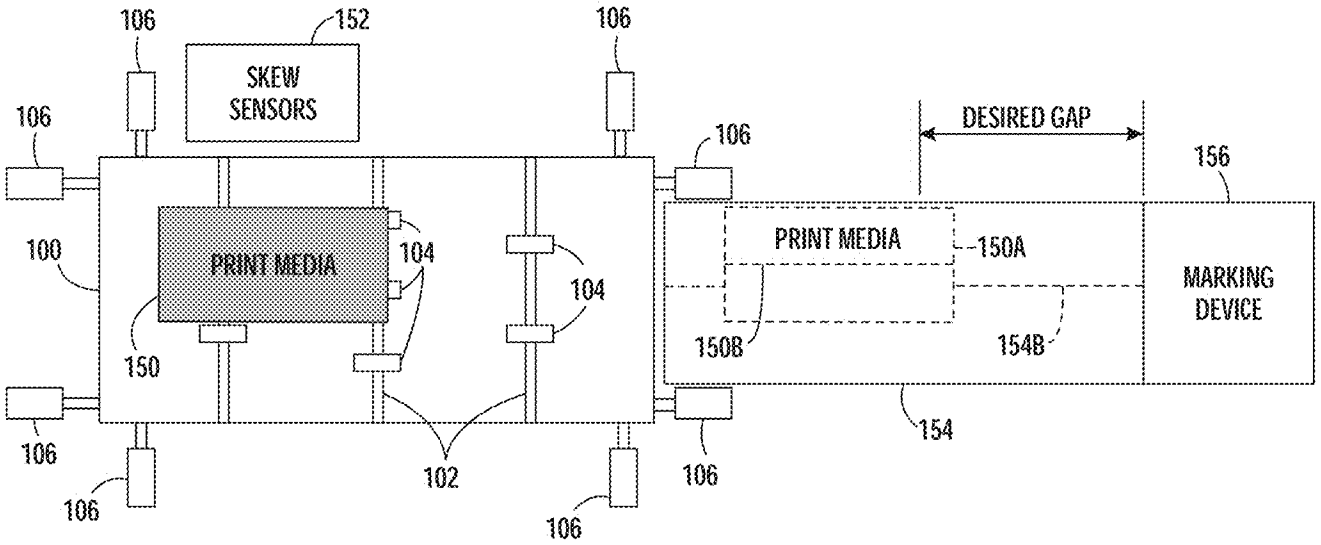
Figure 8B:
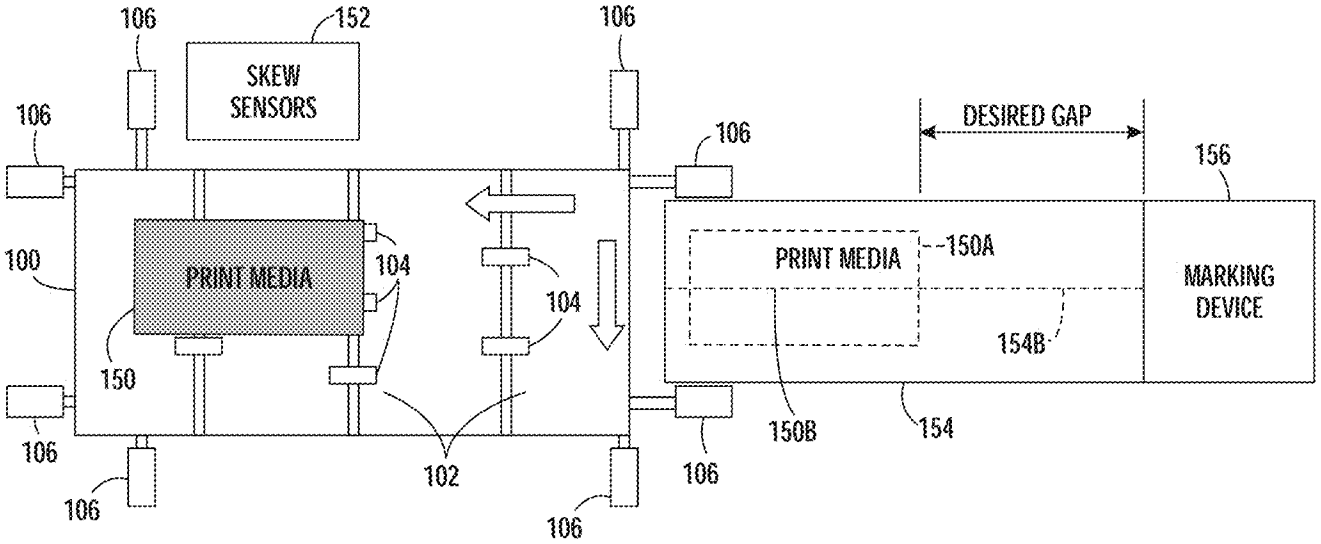
Figure 9:
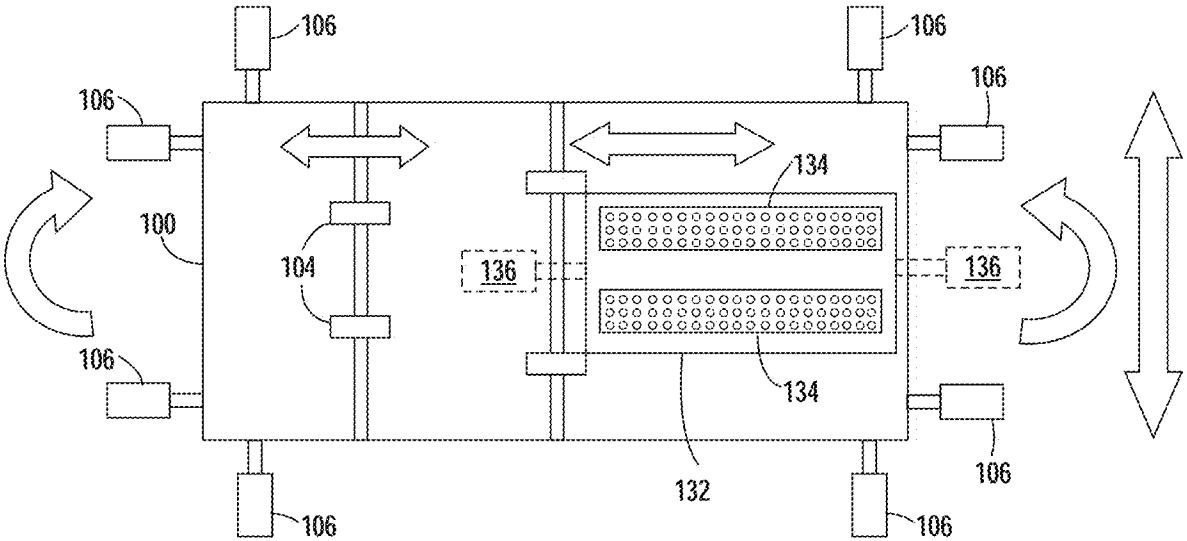
FIGS. 9-10 are schematic conceptual diagrams illustrating alignment devices herein.

FIG. 8A illustrates a situation where the sheet of print media 150 is detected by the skew sensor 152 to have lateral offset and for there to be too small of a gap in the processing direction (see the "Desired Gap" measure in FIGS. 8A-8B) indicating that the sheet needs to be retarded in the processing direction to avoid being located in position 150A shown in FIG. 8A. Therefore, as shown by the block arrows in FIG. 8B, the controller 224 moves the frame 100 in the cross-processing direction to compensate for the lateral offset, and simultaneously moves the frame 100 to retard the frame 100 opposite the processing direction to increase the gap and compensate for the too small of a gap shown in FIG. 8A. FIGS. 8A-8B are again illustrated using exemplary midline 150B and alignment position 154B in FIGS. 8A-8B.

Figure 10:
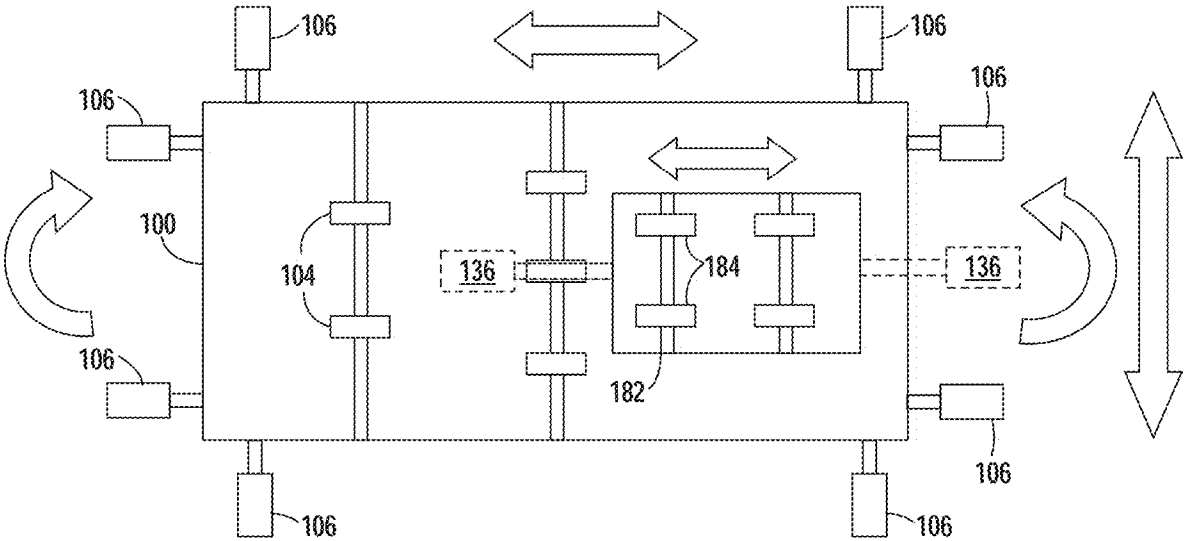

While belts and drive nips are mentioned above, FIG. 9 illustrates one structure herein that includes drive nips 104 in the primary frame 100 and belts 134 in the secondary frame. In contrast, FIG. 10 illustrates a structure where both the primary and secondary frames 100, 182 include drive nips 104, 184. In all the foregoing structures, after the print media 150 is delivered to the marking transport 154, the rotatable transport 100 can be re-centered, and then adjusted to compensate for the skew of the next sheet. The re-centering process can occur between every sheet, or periodically (e.g., every other sheet, every $5^{th}$ sheet, every 20 seconds, once a minute, etc.).

Figure 11:
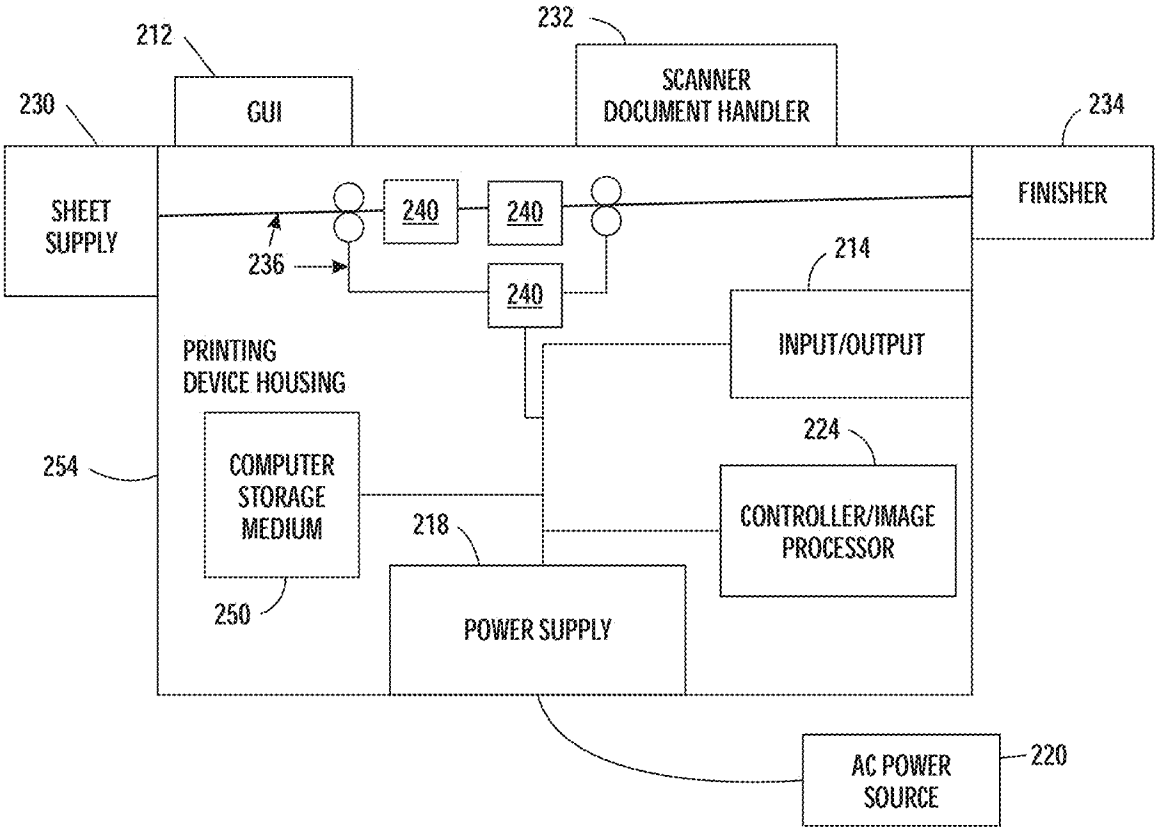
FIG. 11 is a schematic diagram illustrating printing devices herein.

FIG. 11 illustrates many components of printer structures 204 herein that can comprise, for example, a printer, copier, multi-function machine, multi-function device (MFD), etc. The printing device 254 includes a controller/tangible processor 224 and a communications port (input/output) 214 operatively connected to the tangible processor 224 and to a computerized network external to the printing device 254. Also, the printing device 254 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 254 and comprises a wired device or wireless device (of any form, whether currently known or developed in the future). The tangible processor 224 controls the various actions of the printing device 254. A non-transitory, tangible, computer storage medium device 250 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 11, a body housing has one or more functional components that operate on power supplied from an alternating current (AC) source 220 by the power supply 218. The power supply 218 can comprise a common power conversion unit, power storage element (e.g., a battery, etc), etc.

The printing device 254 includes at least one marking device (printing engine(s)) 240 that use marking material, and are operatively connected to a specialized image processor 224 (that is different from a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 254 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use electrostatic toner printers, inkjet printheads, contact printheads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An alignment apparatus comprising:

a frame;

contact elements operatively connected to the frame, wherein the contact elements are shaped and positioned to contact items to be transported in a processing direction relative to the frame, wherein the contact elements are in fixed positions relative to the frame, and wherein the contact elements are moveable at the fixed positions to move the items to be transported in the processing direction;

adjustable mounts connected to the frame, wherein the adjustable mounts are connected to the frame in locations to move the frame;

a controller electrically connected to the adjustable mounts, wherein the controller is adapted to independently control the adjustable mounts to simultaneously rotate the frame and all the contact elements in a clockwise rotation or a counter-clockwise rotation, wherein the controller is adapted to synchronously control the adjustable mounts to simultaneously move the frame and all the contact elements in a cross-processing direction that is perpendicular to the processing direction relative to the processing direction, and wherein the controller is adapted to synchronously control the adjustable mounts to simultaneously move the frame and all the contact elements in the processing direction;

a secondary frame positioned within a perimeter of the frame;

secondary contact elements operatively connected to the secondary frame, wherein the secondary contact elements are shaped and positioned to contact the items to be transported, wherein the secondary contact elements are in secondary fixed positions relative to the secondary frame, and wherein the secondary contact elements are moveable at the secondary fixed positions to move the items to be transported in the processing direction; and secondary adjustable mounts connected to the secondary frame and the frame, wherein the secondary adjustable mounts are connected to the secondary frame in locations to move the secondary frame parallel to the processing direction of the frame.

2. The alignment apparatus according to claim 1, wherein the secondary adjustable mounts are electrically connected to the controller, wherein the controller is adapted to control the secondary adjustable mounts to move the secondary frame in the processing direction while simultaneously rotating the frame and moving the frame in the cross-processing direction.

3. The alignment apparatus according to claim 1, wherein the adjustable mounts include:

first adjustable mounts positioned to move the frame in the cross-processing direction; and second adjustable mounts positioned to move the frame in the processing direction.

4. The alignment apparatus according to claim 1, wherein the controller is adapted to control the adjustable mounts to simultaneously rotate the frame while moving the frame in the processing direction and the cross-processing direction.

5. The alignment apparatus according to claim 1, further comprising a sensor electrically connected to the controller, wherein the sensor is positioned to detect an alignment of the items to be transported relative to the processing direction.

6. The alignment apparatus according to claim 1, wherein the contact elements comprise at least one of: rollers forming drive nips; and vacuum belts.

7. The alignment apparatus according to claim 1, wherein the controller is adapted to synchronously control the adjustable mounts to simultaneously move the frame and all the contact elements in the cross-processing direction to compensate for lateral offset of the items to be transported from an alignment position.

8. An alignment apparatus comprising:

a frame having a rectangular shape;

drive nips operatively connected to the frame, wherein the drive nips contact items to be transported in a processing direction relative to the frame, wherein the drive nips are in fixed positions relative to the frame, and wherein the drive nips are rotatable at the fixed positions to move the items to be transported in the processing direction;

actuators connected to corners of the frame;

a controller electrically connected to the actuators, wherein the controller is adapted to independently control the actuators to simultaneously rotate the frame and all the drive nips in a clockwise rotation or a counter-clockwise rotation, wherein the controller is adapted to synchronously control the actuators to simultaneously move the frame and all the drive nips in an inboard cross-processing direction or simultaneously move the frame and all the drive nips in an outboard cross-processing direction, wherein the inboard cross-processing direction and the outboard cross-processing direction are opposite directions that are perpendicular to the processing direction, and wherein the controller is adapted to synchronously control the actuators to simultaneously move the frame and all the drive nips in the processing direction or simultaneously move the frame and all the drive nips in a retard direction that is opposite the processing direction;

a secondary frame positioned within a perimeter of the frame;

secondary drive nips operatively connected to the secondary frame and the frame, wherein the secondary drive nips are shaped and positioned to contact the items to be transported, wherein the secondary drive nips are in secondary fixed positions relative to the secondary frame, and wherein the secondary drive nips are moveable at the secondary fixed positions to move the items to be transported in the processing direction; and secondary actuators connected to the secondary frame, wherein the secondary actuators are connected to the secondary frame in locations to move the secondary frame parallel to the processing direction of the frame.

9. The alignment apparatus according to claim 8, wherein the actuators include:

first actuators positioned to move the frame in the inboard cross-processing direction and the outboard cross-processing direction; and second actuators positioned to move the frame in the processing direction and the retard direction.

10. The alignment apparatus according to claim 8, wherein the controller is adapted to control the actuators to simultaneously rotate the frame while simultaneously moving the frame and all the drive nips in the processing direction, the retard direction, the inboard cross-processing direction, and the outboard cross-processing direction.

11. The alignment apparatus according to claim 8, wherein the secondary actuators are electrically connected to the controller, wherein the controller is adapted to control the secondary actuators to move the secondary frame in the processing direction or the retard direction while simultaneously rotating the frame and moving the frame in the inboard cross-processing direction or the outboard cross-processing direction.

12. The alignment apparatus according to claim 8, further comprising a sensor electrically connected to the controller, wherein the sensor is positioned to detect an alignment of the items to be transported relative to the processing direction.

13. The alignment apparatus according to claim 8, wherein the controller is adapted to synchronously control the actuators to simultaneously move the frame and all the drive nips in the inboard cross-processing direction or simultaneously move the frame and all the drive nips the outboard cross-processing direction to compensate for lateral offset of the items to be transported from an alignment position.

* * * * *